United States Patent [19]

Hayakawa et al.

[11] Patent Number: 4,854,617

[45] Date of Patent: Aug. 8, 1989

[54] DOOR LOCK FOR AUTOMOTIVE VEHICLES

[75] Inventors: Shigeru Hayakawa, Chiryu; Daiichi Shiraishi, Seto; Hisakazu Murakami, Toyota, all of Japan

[73] Assignees: Aisin Seiki Kabushiki Kaisha; Toyota Jidosha Kabushiki Kaisha, both of Japan

[21] Appl. No.: 66,070

[22] Filed: Jun. 24, 1987

[30] Foreign Application Priority Data

Jun. 28, 1986 [JP] Japan ..... 61-99442[U]
Jul. 29, 1986 [JP] Japan ..... 61-116105[U]

[51] Int. Cl.[4] ..... E05C 3/26

[52] U.S. Cl. ..... 292/216; 297/DIG. 56; 297/DIG. 38

[58] Field of Search ..... 292/216, DIG. 56, DIG. 38, 292/207, 341-12, 304

[56] References Cited

U.S. PATENT DOCUMENTS

| | | | |
|---|---|---|---|
| 3,767,243 | 10/1973 | Yoshimura | 292/216 |
| 3,917,330 | 11/1975 | Quantz | 292/216 |
| 4,073,519 | 2/1978 | Kuroyu et al. | 292/216 |
| 4,586,737 | 5/1986 | Arlauskas | 292/207 X |
| 4,756,564 | 7/1988 | Ikeda | 292/216 |

FOREIGN PATENT DOCUMENTS

| | | |
|---|---|---|
| 2320351 | 4/1987 | Fed. Rep. of Germany . |
| 58-44221 | 10/1983 | Japan . |

*Primary Examiner*—Richard E. Moore
*Attorney, Agent, or Firm*—Finnegan, Henderson, Farabow, Garrett & Dunner

[57] ABSTRACT

A door lock for an automotive vehicle includes a door lock striker fixedly secured to the vehicle body, a base provided on the vehicle door, a latch freely rotatably supported on the base by a pin and adapted to engage and disengage the striker, a silencer provided on the latch, and arcuate projections provided on the silencer and base and having the pin at the center thereof, the arcuate projections being brought into overlapping relation with each other so as to force the latch away from the base when the door is fully closed. Further, the latch is integrally molded to include a resilient projection at a portion where the striker and the latch engage each other, the projection being located near a position occupied by the striker when the door is fully closed, whereby a resilient press-fitted relation is established between the striker and the latch to eliminate abnormal sounds caused by looseness of the latch in the thickness direction thereof.

9 Claims, 5 Drawing Sheets

DOOR LOCK FOR AUTOMOTIVE VEHICLES

FIELD OF THE INVENTION

This invention relates to an automotive vehicle door lock that enables a door on an automotive vehicle to be opened and closed quietly by minimizing metallic sounds and other abnormal sounds produced by interaction between a latch and base.

BACKGROUND OF THE INVENTION

As shown in FIGS. 11 and 12, a prior-art door lock for an automotive vehicle includes a latch 1 operatively associated with a ball, not shown, and a base 3 on which the latch 1 is freely rotatably supported by a pin 2 fixedly secured to the base 3. The pin 2 has a flange 4 for retaining the latch 1 between itself and the base 3. A gap between the pin 2 and the wall of a pin insertion hole in the latch 1, and a gap between latch 1 and base 3 enable the latch 1 to move freely with respect to the base 3 and pin 2 but allow an abnormal noise to be produced due to impact between these metal components when the door is opened and closed. For this reason the latch 1 is equipped with a silencer 5. The latter includes a spacer portion 6 and a leaf spring portion 7. The spacer portion 6 is inserted into the pin insertion hole of latch 1, and the leaf spring portion 7 is interposed between the base 3 and latch 1 to urge the latch 1 into resilient contact with the flange 4 of pin 2. The spacer portion 6 suppresses movement of the latch 1 radially of the pin 2, and the leaf spring portion 7 prevents the latch 1 from striking the base 3, thereby minimizing the generation of abnormal noises when the door is opened and closed.

A problem encountered in this prior-art arrangement is that as the spring force of the leaf spring portion 7 is weakened its ability to limit backlash is impaired. Though this reduces the frictional resistance of the rotating surface of the latch, the silencing effect is adversely affected.

Accordingly, the prior-art approach inevitably is to provide the leaf spring portion 7 with a large spring force in order to minimize the generation of abnormal sounds produced by the striking contact between the latch 1 and base 3. However, when a large spring force acts upon the latch 1 at all times, the rotation of the latch 1 meets resistance over the entire region thereof, though the generation of abnormal sounds is indeed greatly reduced. When the door is opened from the completely closed state by pulling on the door opening handle, the latch cannot return to its original position merely under the force of a return spring because of the increased resistance memtioned above. Instead, the latch comes to reside at an intermediate position. This can impede the locking of the door.

SUMMARY OF THE INVENTION

An object of the present invention is to overcome the problems and disadvantages of the prior art.

Accordingly, an object of the present invention is to provide an automotive vehicle door lock capable of minimizing the generation of abnormal sounds while at the same time assuring that the latch will return to its initial position.

To achieve the objects and in accordance with the purpose of the present invention, as embodied and broadly herein, the present invention comprises a door lock for an automotive vehicle comprising a door lock striker fixedly secured to a body of the vehicle, a base provided on a door of the vehicle, a latch freely rotatably supported on the base by a pin and adapted to engage and disengage the striker, a silencer provided on the latch, and an arcuate projection provided on at least one of the silencer and the base and having the pin as a center, the arcuate projection being brought into overlapping relation with the other one of the silencer and the base so as to force the latch away from the base when the door is fully closed. Further, the latch is integrally molded to include a resilient projection at a portion where the striker and the latch engage each other, the projection being located near a position occupied by the striker when the door is fully closed, whereby a resilient press-fitted relation is established between the striker and the latch to eliminate abnormal sounds caused by looseness of the latch in the thickness direction thereof.

When the door is fully closed, the above-described overlapping condition causes the latch to be forced away from the base so that the two will not be in contact with each other. When the door is fully opened, the overlapping condition is eliminated so that the latch can be returned reliably to its initial position.

Further, when the door is closed, the striker engages the latch in a press-fitted relation owing to the resilient projection of the latch, whereby the frictional resistance at the engaging portions of the striker and latch is increased. The greater frictional resistance eliminates looseness and backlash of the latch in the thickness direction thereof. This in turn eliminates the generation of abnormal noise.

BRIEF DESCRIPTION OF THE DRAWINGS

The accompanying drawings, which are incorporated in and constitute a part of this specification, illustrate several embodiments of the present invention and together with the description, serve to explain the principles of the present invention.

DESCRIPTION OF THE PREFERRED EMBODIMENTS

Figure 1:
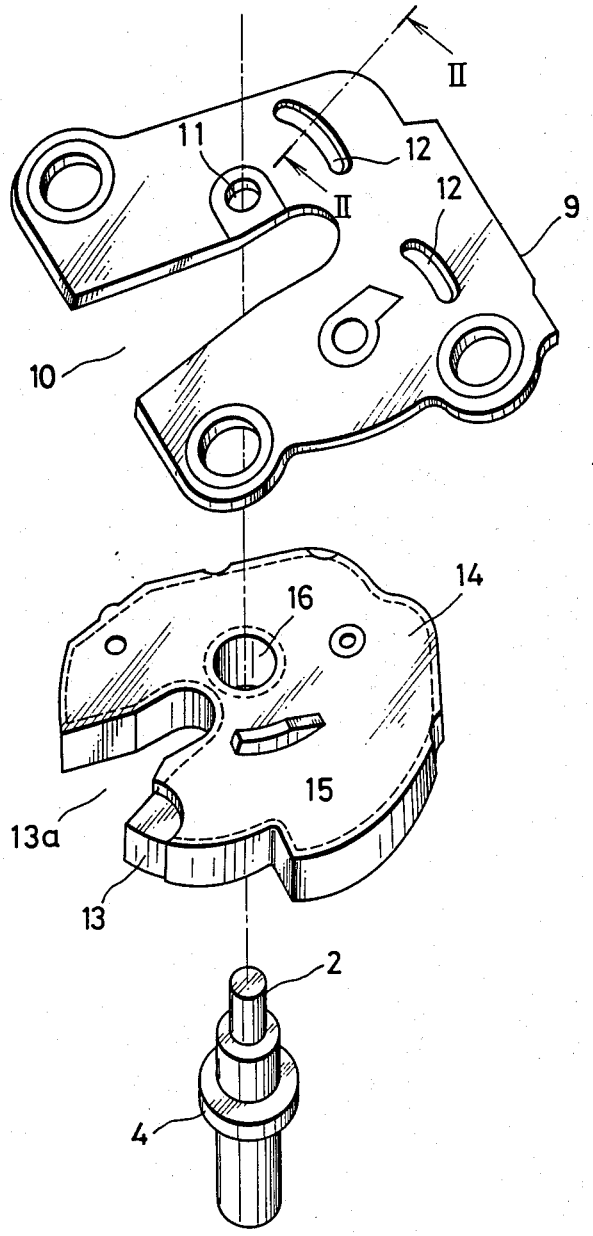
FIG. 1 is an exploded view illustrating a first embodiment of a door lock according to the present invention.
Figure 2:
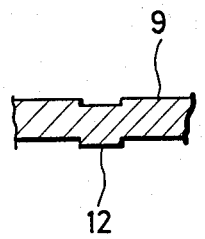
FIG. 2 is a sectional view taken along line II—II of FIG. 1.

A first embodiment of the present invention will now be described with reference to FIGS. 1 through 5. The door lock of the first embodiment includes a base 9 having a cut-out 10 for receiving a striker, described below, and a hole 11 into which the pin 2 is inserted. The base 9 is also provided with an arcuate first projection 12 (FIG. 2) on a circle having the pin hole 11 as its center. The door lock further includes a latch 13 having a U-shaped groove 13*a* corresponding to the cut-out 10. The latch 13 is provided with a silencer 14, which is formed by insert molding, consisting of a synthetic resin, such as a polyester elastomer. The silencer 14 has an upstanding second projection 15 provided on its upper surface. The second projection 15 is situated on a circle the center whereof is a hole 16 through which the pin 2 is inserted, and has a generally wedge-shaped cross section, as shown in FIG. 5. As illustrated in FIG. 1, the pin 2 having the flange 4 is passed through the hole 16 of latch 13 and is caulked in the hole 11 of base 9, so that the latch 13 is freely rotatably supported on the base 9 about the pin 2.

Figure 3:
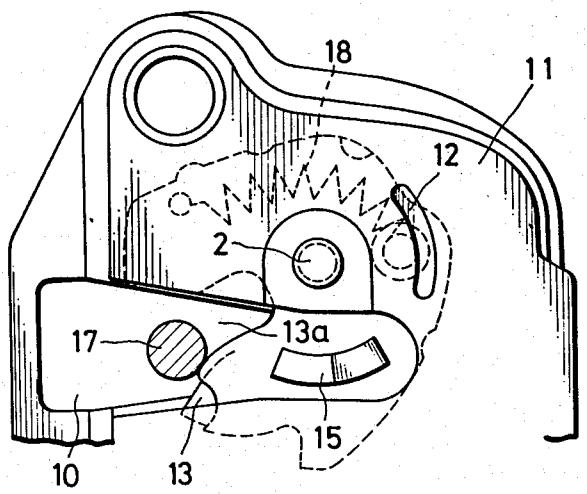
FIG. 3 is a plan view showing the door lock when the door is open.

In FIG. 3 the aforementioned striker, indicated at numeral 17, is shown to be situated in the vicinity of the cut-out 10 of base 9. This illustrates the door lock when the door is in the open state. In such state the latch 13 is returned to its original position by a return spring 18, and the two projections 12, 15 are separated from each other though they lie on the same circle. If the door is now closed, the striker 17 is received in the cut-out 10 of latch 13 and is then forced into the cut-out 10 while latch 13 is rotated. This results in the state shown in FIG. 4, in which the door is fully closed. Before this state is attained, however, the inclined surface of the wedge-shaped second projection 15 engages the first projection 12, and the two projections 12, 15 become perfectly superimposed as the latch 13 rotates, as shown in FIG. 5. This causes the latch 13 to be forced downward so that the latch 13 and base 9 will not strike each other. At this time the lower surface of latch 13 is in pressing contact with the flange 4.

Figure 4:
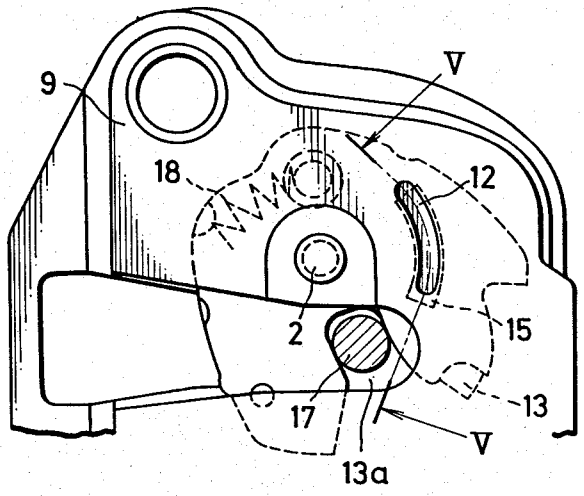
FIG. 4 is a plan view showing the door lock when the door is closed.
Figure 5:
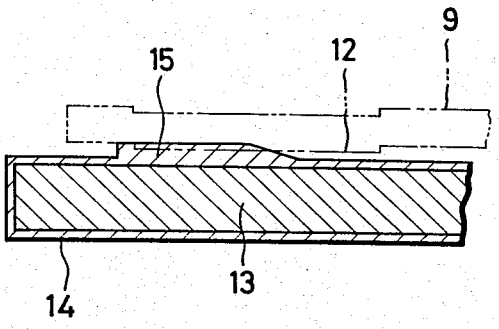
FIG. 5 is a sectional view taken along line V—V of FIG. 4.

When the door is opened starting from the state shown in FIG. 4, the striker 17 travels along the wall of cut-out 10 in base 9 and eventually the projections 12, 15 separate from each other, at which time the maximum frictional resistance between the base 9 and latch 13 vanishes. This allows the spring force of return spring 18 to act upon the latch 13 to the maximum extent, thereby assuring that the latch 13 will return to its initial position.

Figure 6:
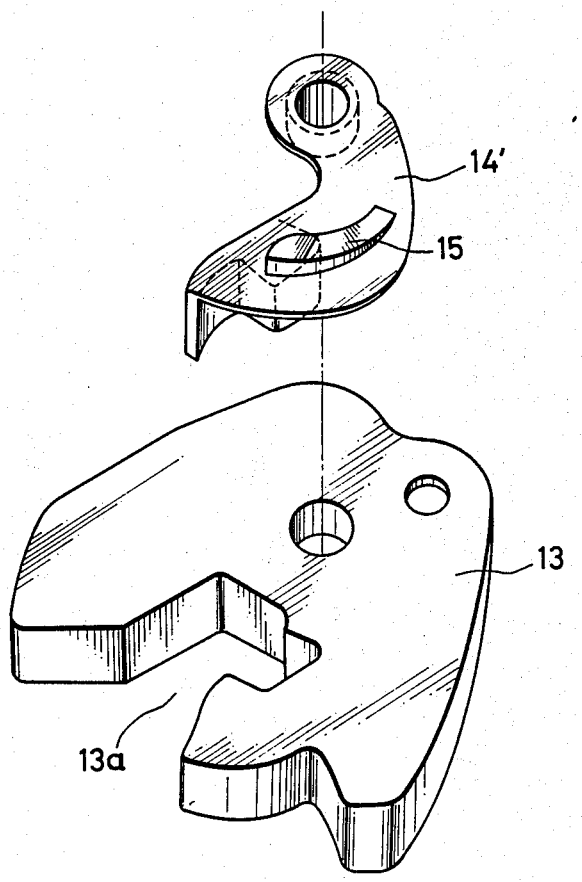
FIG. 6 is a perspective view illustrating a second embodiment of the invention.

FIG. 6 illustrates a second embodiment in which the second projection 15 is provided on a silencer 14' of a type different from that shown in FIG. 6. The operation of this embodiment is exactly the same as that shown in FIGS. 1 through 5.

Figure 7:
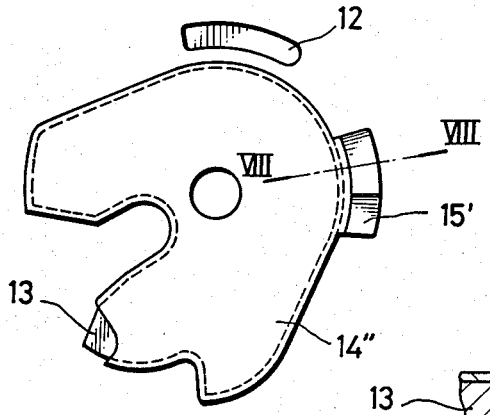
FIG. 7 is a plan view illustrating a third embodiment of the invention.
Figure 8:
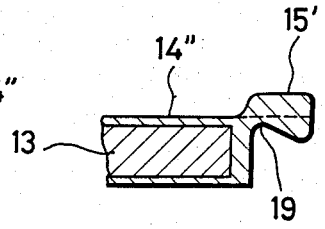
FIG. 8 is a sectional view taken along line VIII—VIII of FIG. 7.

FIGS. 7 and 8 illustrate a third embodiment of the invention, in which the latch 13 is provided with a o silencer 14'' having a second projection 15' provided on a part of its periphery. The first projection 12 of base 9 is provided on the same circle as the projection 15'. The latter has a stem 19 formed to include a recess 19 that increases the flexibility of the projection 15'. The operation of this embodiment is exactly the same as that shown in FIGS. 1 through 5.

It should be noted that the shapes of the projections 12, 15 of base 9 and silencer 14 may be interchanged if desired.

Figure 9:
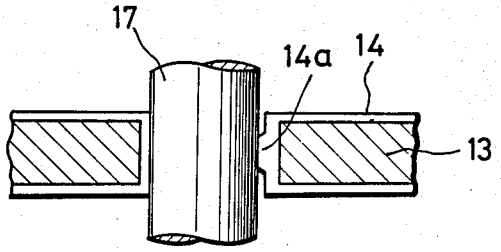
FIG. 9 is a partial sectional view showing a sliding contact relationship between a striker and a silencer.
Figure 10:
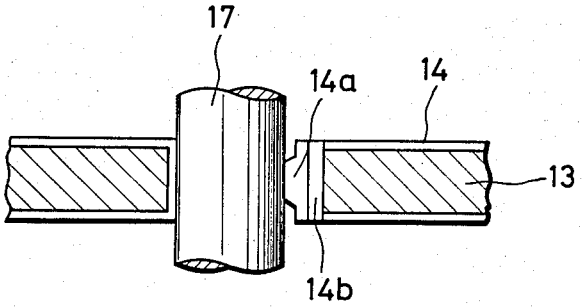
FIG. 10 is a sectional view illustrating a modification of a resilient projection provided on the silencer.
Figure 12:
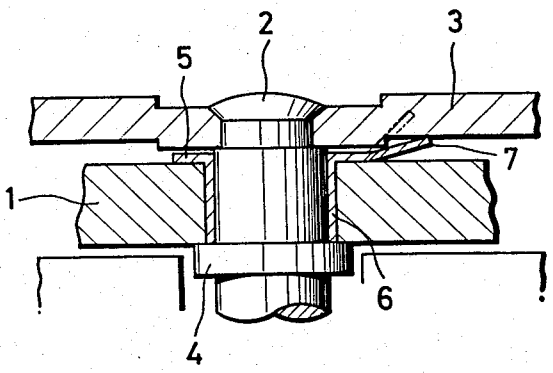
FIG. 12 PRIOR ART
FIG. 12 is a sectional view illustrating the door lock of FIG. 11 in assembled form.
Figure 11:
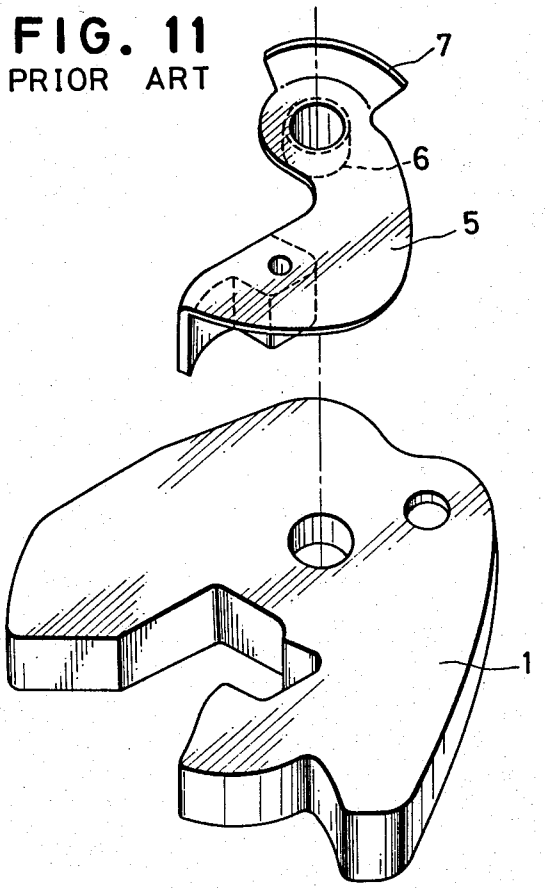
FIG. 11 PRIOR ART
FIG. 11 is an exploded view illustrating a door lock according to the prior art.

FIGS. 9 and 10 illustrate another embodiment of the invention. In FIG. 9, the silencer 14 is integrally molded to include a resilient projection 14*a* at least at one location to protrude into the U-shaped groove 13*a* of latch 13, thereby making the width of the groove 14*a* less than the diameter of the striker 17. As a result, the striker 17 is inserted into the groove 13*a* in a force-fitted state, thereby raising the frictional resistance at the contacting surfaces of the striker 17 and U-shaped groove 13*a* to eliminate backlash or looseness of the latch 11 axially of the pin 2. It should be noted that when the door is in the open state, the striker 17 is not in contact with the resilient projection 14*a* and therefore is not in the force-fitted relation with respect to the groove 13*a*. As a result, the latch 13 is reliably restored to its initial position by turning about the pin 2.

In the modification of FIG. 10, the resilient projection 14*a* molded as an integral part of the silencer 14 is provided with a groove 14*b*. This raises the flexibility of the projection 14*a* and therefore enhances the silencing effect.

Thus, in accordance with the present invention one member, namely the silencer or the base, is provided with a projection which is brought into overlapping relation with respect to the other member just before the door is fully closed. As a result, the person closing the door does not feel a sudden increase in resistance, so that the door can be opened and closed without the person experiencing an abnormal sensation. Furthermore, since the frictional resistance at the contacting surfaces of the striker and latch is increased by virtue of the resilient projection when the door is closed, abnormal sounds produced by backlash or looseness in the thickness direction of the latch are eliminated.

Further, the resilient projection is provided on the latch side near a position at which the door is fully closed. When the door is fully opened, therefore, the latch can turn smoothly since the striker will not be in the press-fitted relation with respect to the U-shaped groove of the latch. Thus, the opening and closing function of the door is not impaired.

Other embodiments of the present invention will be apparent to those skilled in the art from consideration of the specification and practice of the disclosed invention. It is intended that the specification and examples be considered as exemplary only, with the true scope and spirit of the invention being represented by the following claims.

What is claimed is:

1. A door lock for an automotive vehicle, comprising:

a door lock striker fixedly secured to a body of the vehicle;

a base disposed on a door of the vehicle and including a first arcuate projection;

a latch freely rotatably supported on said base by a pin and adapted to engage and disengage said striker;

a silencer covering a peripheral portion of said latch and having an outer surface said silencer including a second arcuate projection extending from said outer surface of said silencer toward said base;

said second arcuate projection being pivoted into engagement with said first arcuate projection to urge said latch away from said base when the door in fully closed.

2. A door locked according to claim 1, wherein said silencer is formed of a synthetic resin and covers substantially the entire surface of said latch, said first arcuate projection having a wedge-shaped cross section.

3. The door lock according to claim 1, wherein said silencer is provided solely at a U-shaped groove formed in said latch.

4. The door lock according to claim 1, wherein said silencer is formed of synthetic resin and includes a side face, said first arcuate projection extending outwardly from said side face of said silencer.

5. The door lock according to claim 4, wherein said second arcuate projection includes a recessed stem portion.

6. A door lock for an automotive vehicle comprising:

a door lock striker fixedly secured to a body of the vehicle;

a base provided on a door of the vehicle;

a latch freely rotatably supported on said base by a pin and adapted to engage and disengage said striker; and a silencer provided on said latch;

said latch being integrally molded to include a resilient projection at a portion where said striker and said latch engage each other, said projection being located near a position occupied by said striker when the door is fully closed, whereby a resilient press-fitted relation is established between said striker and said latch to eliminate abnormal sounds caused by looseness of said latch in a thickness direction thereof.

7. The door lock according to claim 6, wherein said projection is provided with a cavity.

8. A door lock for an automotive vehicle, comprising:

a door lock striker fixedly secured to a body of the vehicle;

a base provided on a door of the vehicle;

a latch freely rotatably supported on said base by a pin and adapted to engage and disengage said striker;

a silencer provided on said latch; and an arcuate projection provided on at least one of said silencer and said base and having said pin as a center, said arcuate projection being brought into overlapping relation with the other one of said silencer and said base so as to force said latch away from said base when the door is fully closed;

said latch being integrally molded to include a resilient projection at a portion where said striker and said latch engage each other, said resilient projection being located near a position occupied by said striker when the door in fully closed, whereby a resilient press-fitted relation is established between said striker and said latch to eliminate abnormal sounds caused by looseness in a thickness direction of said latch.

9. The door lock according to claim 1, wherein said latch includes a groove for receiving said striker and said silencer includes a projection disposed along said groove for engaging said striker when the door is fully closed to minimize backlash of said latch.

* * * * *